US012428954B2

(12) United States Patent
Jan et al.

(10) Patent No.: US 12,428,954 B2
(45) Date of Patent: Sep. 30, 2025

(54) SELF-EXPLAINING MODEL FOR DOWNHOLE CHARACTERISTICS

(71) Applicant: Schlumberger Technology Corporation, Sugar Land, TX (US)

(72) Inventors: Aymeric Jan, Paris (FR); Tianjun Hou, Antony (FR); Zoryana Snovida, Houston, TX (US); Matthew Blyth, Fulshear, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/734,351

(22) Filed: Jun. 5, 2024

(65) Prior Publication Data

US 2024/0410275 A1 Dec. 12, 2024

(30) Foreign Application Priority Data

Jun. 6, 2023 (EP) ..... 23305898

(51) Int. Cl.
*E21B 47/14* (2006.01)
*E21B 33/13* (2006.01)

(52) U.S. Cl.
CPC ..... *E21B 47/14* (2013.01); *E21B 33/13* (2013.01); *E21B 2200/22* (2020.05)

(58) Field of Classification Search
CPC ..... E21B 47/14; E21B 33/13; E21B 2200/22; E21B 47/005
See application file for complete search history.

(56) References Cited

U.S. PATENT DOCUMENTS

| | | | | |
|---|---|---|---|---|
| 12,298,459 | B2 * | 5/2025 | Bestman | G01V 20/00 |
| 12,327,168 | B2 * | 6/2025 | Cella | H03M 1/12 |
| 2018/0349508 | A1 * | 12/2018 | Bequet | G06F 18/217 |
| 2023/0097490 | A1 * | 3/2023 | Chen | G01V 8/02 166/264 |
| 2023/0151696 | A1 * | 5/2023 | Weideman | E21B 7/046 175/27 |
| 2023/0184655 | A1 * | 6/2023 | Adams | G01N 11/00 73/152.18 |
| 2023/0308605 | A1 * | 9/2023 | Ritchey | H04N 21/4305 |
| 2023/0392592 | A1 * | 12/2023 | Shampine | E21B 43/2607 |
| 2024/0004100 | A1 * | 1/2024 | Kruspe | G01V 3/38 |
| 2024/0084689 | A1 * | 3/2024 | Shrivastava | G06N 3/0442 |
| 2024/0191614 | A1 * | 6/2024 | Hoefel | F04B 49/065 |
| 2024/0218791 | A1 * | 7/2024 | Hohl | E21B 49/005 |
| 2024/0311446 | A1 * | 9/2024 | Jones | G06F 18/285 |

* cited by examiner

*Primary Examiner* — Amine Benlagsir
(74) *Attorney, Agent, or Firm* — Dayo Aladeniyi

(57) ABSTRACT

Systems and methods of the present disclosure provide systems and methods related to obtaining, at one or more neural networks, log data from a wellbore and generating, using a multi-head attention layer of the one or more neural networks, a zone of interest based on probability-based weights applied to the log data. The one or more neural networks analyze the log data to infer a downhole characteristic and output an indication of an inference of the downhole characteristic and the zone of interest. Then, a computing system performs an action based at least in part on indication of the inference.

20 Claims, 8 Drawing Sheets

SELF-EXPLAINING MODEL FOR DOWNHOLE CHARACTERISTICS

This application claims priority to and the benefit of European Patent Application No. 23305898.1, titled "Self-Explaining Model for Downhole Characteristics," filed Jun. 6, 2023, the entire disclosure of which is hereby incorporated herein by reference.

FIELD OF THE INVENTION

The present disclosure relates to systems and methods for determining a downhole characteristic (e.g., top of cement) and outputting the result as well as a zone of interest used in determining the result.

BACKGROUND INFORMATION

Wellbores in downhole wells have complex and varied surroundings. Thus, applying machine learning to wellbore log-related applications may be difficult due to such high complexity and due to the diversity of the subsurface. Deep learning neural networks have been used in the domain of artificial intelligence for many years. They have shown remarkable results in obtaining accurate results across a wide variety of applications. In addition, neural network-based artificial intelligence (AI) models do not require feature engineering, which largely improves the efficiency of AI model design. However, due to the nature of well log data, it may incomplete or have artifacts that appear as incorrect data. The consequences of a decision based on this incorrect data from an AI source can be severe. The severity of using incorrect/incomplete data may be more severe based on the technical field in which it is deployed (e.g., the field of oil and gas well integrity).

Additionally, in wellbore log-related applications, some common challenges when developing and/or using machine learning based solutions is the high complexity and diversity of the subsurface and the large amount of data that may be available in well logs used to obtain a result using machine learning. Furthermore, due to the nature of the well logs, the output of a neural network using the machine learning may be difficult to verify directly from the well log data in part due to the potentially voluminous amount of data in the well logs and the at least partial loss of the time benefit in using the AI models when verifying the results from raw data.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method including obtaining, at one or more neural networks, log data from a wellbore and generating, using a multi-head attention layer of the one or more neural networks, a zone of interest based on probability-based weights applied to the log data. The one or more neural networks analyze the log data to infer a downhole characteristic and output an indication of an inference of the downhole characteristic and the zone of interest. Then, a computing system performs an action based at least in part on indication of the inference.

In addition, certain embodiments of the present disclosure include a method that includes obtaining, using one or more acoustic tools, acoustic log data from a wellbore. The method also includes generating, using a first multi-head attention layer of one or more neural networks, a first set of probability-based weights applied to the acoustic log data and a zone of interest based on the first set of probability-based weights. Moreover, the method includes analyzing, in a first set of network layers of the one or more neural networks, the acoustic log data to generate first output data based at least in part on the first set of probability-based weights. The method further includes transposing the first output data in one or more transposition layers of the one or more neural networks and generating, using a second multi-head attention layer of the one or more neural networks, a second set of probability-based weights applied to the transposed first output data. The method further includes analyzing, in a first set of network layers of the one or more neural networks, the transposed first output data to generate second output data based at least in part on the second set of probability-based weights and applying a transfer function to the second output data to infer a downhole characteristic based at least in part on the first and second output data and the first and second sets of probability-based weights. The one or more neural networks output an indication of an inference of the downhole characteristic and an indication of the zone of interest, and a computer system performs an action based at least in part on indication of the inference.

Further, certain embodiments of the present disclosure include a system including memory storing instructions. The system also includes a processor configured to execute the instructions to cause the processor to receive acoustic log data from a wellbore and to generate, using a multi-head attention layer of one or more neural networks, a zone of interest based on probability-based weights applied to the acoustic log data. The instructions further cause the processor to analyze, in the one or more neural networks, the acoustic log data to infer a top of cement depth in the wellbore and to generate an indication of an inference of the top of cement depth and an indication of the zone of interest. Furthermore, the instructions cause the processor to perform an action based at least in part on indication of the inference.

BRIEF DESCRIPTION OF THE DRAWINGS

Various aspects of this disclosure may be better understood upon reading the following detailed description and upon reference to the drawings, in which.

DETAILED DESCRIPTION

Figure 1:
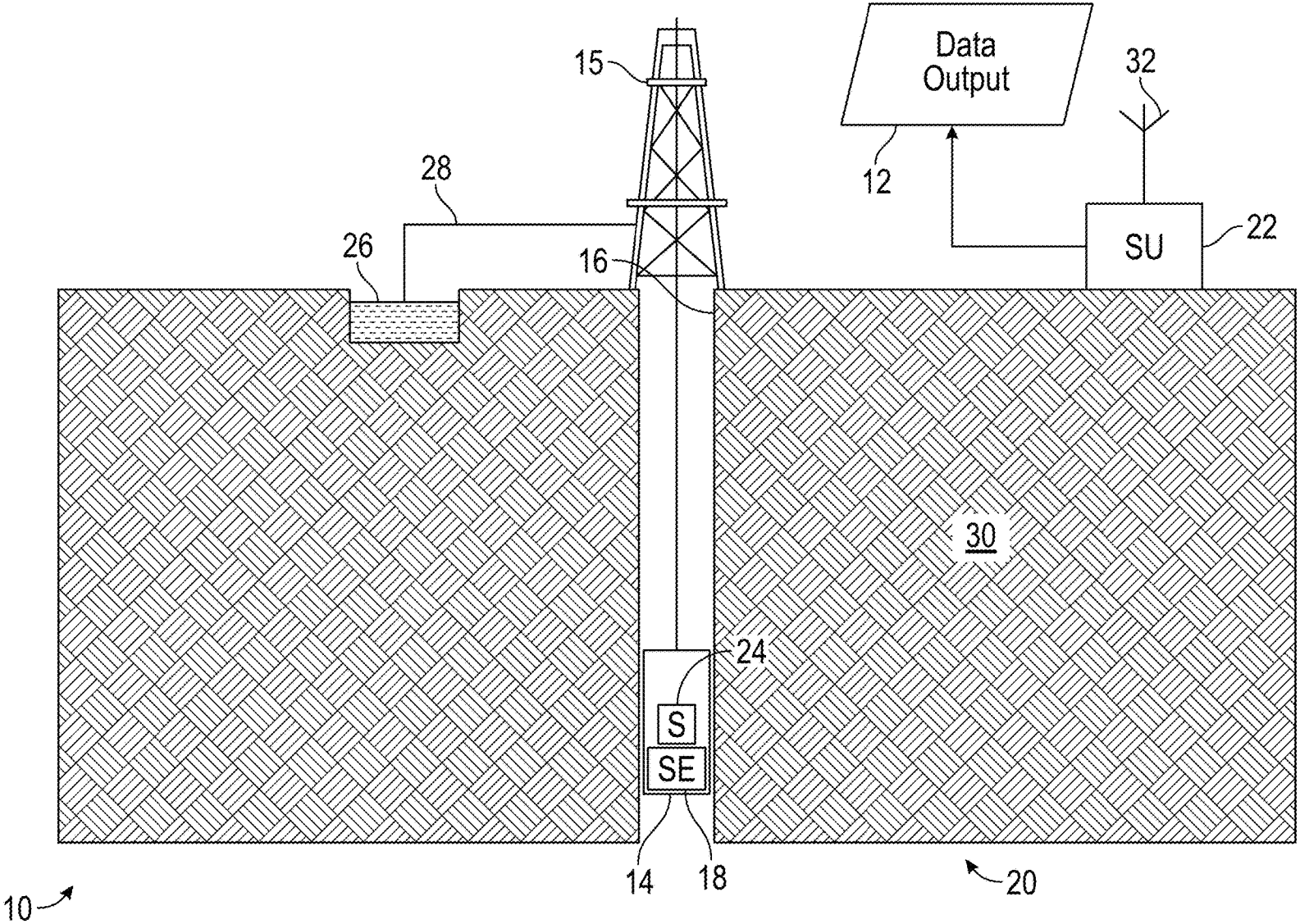
FIG. 1 illustrates a diagram of a data capturing system for a wellbore used to capture data in and/or around an oilfield, in accordance with embodiments of the present disclosure.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower". "upwardly" and "downwardly", and other like terms indicating relative positions above or below a given point are used in this description to more clearly describe certain embodiments.

As previously noted, it may be difficult to obtain complete/accurate conditions in and around wellbores. This data may be important in proper well construction/usage. For instance, the confirmation of cementing success is a key part of safe and successful oil and gas well construction. There are a variety of methods that may validate the extent and circumferential coverage of cement behind a casing in the wellbore. For instance, the extent and circumferential coverage may be determined using calculations of pumped volumes versus estimates of hole size and/or using advanced borehole acoustic logging tools run on a wireline to determine a top of cement (TOC). This method uses acoustic waveforms acquired inside of the casing to determine the shallowest depth to which cement was placed behind the casing. These measurements can be made with acoustic logging tools conveyed on a wireline or logging-while-drilling (LWD) technology. The interpretation of the acquired waveforms may be performed manually using a combination of waveform characteristics including calculated amplitudes and results of slowness-time-coherence (STC) processing on the waveforms. This interpretation often takes a considerable amount of time, particularly if the data is to be transferred to a remote center for processing and interpretation. Furthermore, the amount of delay in obtaining results can be at least partially processor-dependent.

To at least partially mitigate the interpretation delays, self-explainable deep learning neural network(s) may be used to automate interpretation of TOC (or other properties) from LWD or other wireline-based waveforms (e.g., sonic waveforms). Although deep learning networks may be accurate across a wide variety of applications, they may be more susceptible to bad results from incorrect or incomplete data that may occur in well logs using the LWD or other wireline tool-based waveforms. Thus, a decision based on incorrect/incomplete data from an AI source may be more problematic than human interpretation. The field of application (e.g., the field of oil and gas well integrity) may further increase the severity of the incorrect/incomplete problem. One mechanism may include checking AI-based determinations. However, due to the opacity with which AI models usually function, the checking function may require completing the whole human interpretation from scratch that may be quite a lengthy ordeal. To address this issue, AI models may be explainable so that users can understand how the AI provided the inference and whether the results are likely correct/trustworthy. A self-explainable AI system may interpret the acoustic data and also highlight a zone of interest corresponding to the data considered by the AI system to provide the interpretation. Such a zone of interest provides justification of the given output from the AI model that may be verified using much less time/analysis. Thus, an AI engine may apply mechanisms to infer a characteristic (e.g., TOC) and also provide a zone of interest justification that shows where the focus was in determining the inferred characteristic. The inference and/or the zone of interest justification may be made using visual/graphical representations or using data and/or text. Furthermore, although the following primarily discusses an interpretation of TOC, the self-explainable AI system discussed in this application may be applicable to other fields, such as other downhole measurements and related inferences.

With the foregoing in mind, FIG. 1 illustrates a data capturing system 10 to capture and produce data output 12 in an oilfield that is captured as part of a wireline operation, pumping operation, drilling operation, extraction operation, or any other operation being performed. In the illustrated embodiment, the data capture is being at least partially performed by a wireline tool 14 suspended by a rig 15 and into a wellbore 16. The wireline tool 14 is adapted for deployment into wellbore 16 for generating well logs, performing downhole tests, collecting samples, and/or collecting any other data. For instance, the wireline tool 14 may assist in performing a seismic survey operation. Additionally or alternatively, the wireline tool 14 may, for example, have an explosive, radioactive, electrical, or acoustic energy source 18 that sends and/or receives electrical signals to surrounding subterranean formations 20 and/or fluids therein. Return signals may be detected using the wireline tool 14 and/or other tools located at other locations at/near the oilfield.

Computer facilities may be positioned at various locations about the oilfield (e.g., the surface unit 22) and/or at remote locations. The surface unit 22 may be used to communicate with the wireline tool 14 and/or offsite operations, as well as with other surface or downhole sensors. The surface unit 22 is capable of communicating with the wireline tool 14 to send commands to the wireline tool 14 and to receive data from the wireline tool 14. The surface unit 22 may also collect data generated during the drilling operation and/or logging and produces data output 12, which may then be stored or transmitted. In other words, the surface unit 22 may collect data generated during the wireline operation and may produce data output 12 that may be stored or transmitted. The wireline tool 14 may be positioned at various depths in the wellbore 16 to provide a survey or other information relating to the subterranean formation 20. In some embodiments, the surface unit 22 may include any suitable device, such as a geophone, a seismic truck, a computer, and/or other suitable devices.

The surface unit 22 may include one or more various sensors and/or gauges that may additionally or alternatively be located at other locations in the oilfield. These sensors and/or gauges may be positioned about the oilfield (e.g., in/at the rig 15) to collect data relating to various field operations. As shown, at least one downhole sensor 24 is positioned in the wireline tool 14 to measure downhole parameters which relate to, for example porosity, permeability, fluid composition and/or other parameters of the field operation. During drilling, different or more parameters, such as weight on bit, torque on bit, pressures, temperatures, flow rates, compositions, rotary speed, and/or other parameters of the field operation, may be measured.

The surface unit 22 may include a transceiver 32 to enable communications between the surface unit 22 and various portions of the oilfield or other locations. The surface unit 22 may also be provided with or may be functionally connected to one or more controllers for actuating mechanisms at the oilfield. The surface unit 22 may then send command signals to the oilfield in response to data received. The surface unit 22 may receive commands via the transceiver 32 or may itself execute commands to the controller. A computing system including a processor may be provided to analyze the data (locally or remotely), make decisions, control operations, and/or actuate the controller. In this manner, the oilfield may be selectively adjusted based on the data collected. This technique may be used to enhance portions of the field operation, such as controlling drilling, weight on bit, pump rates, and/or other parameters. These adjustments may be made automatically based on an executing application with or without user input.

As previously noted, at least some of the data output 12 may be captured during logging and/or drilling such that the wireline tool 14 is replaced and/or supplemented by drilling tools suspended by the rig 15 and advanced into the subterranean formations 20 to form the wellbore 16. A mud pit 26 is used to draw drilling mud into the drilling tools via flow line 28 for circulating drilling mud down through the drilling tools, then up wellbore 16 and back to the surface. The drilling mud may be filtered and returned to the mud pit 26. A circulating system may be used for storing, controlling, or filtering the flowing drilling muds. The drilling tools are advanced into subterranean formations 20 to reach a reservoir 30. Each well may target one or more reservoirs. The drilling tools are adapted for measuring downhole properties using logging while drilling tools. The logging while drilling tools may also be adapted for taking core samples.

Drilling tools may include a bottom hole assembly, generally referenced, near the drill bit (e.g., within several drill collar lengths from the drill bit). The bottom hole assembly includes capabilities for measuring, processing, and storing information, as well as communicating with the surface unit 22. The bottom hole assembly further includes drill collars for performing various other measurement functions.

The bottom-hole assembly/wireline tool 14 may include a communication subassembly that communicates with the surface unit 22. The communication subassembly is adapted to send signals to and receive signals from the surface using a communications channel such as mud pulse telemetry, electro-magnetic telemetry, or wired drill pipe communications. The communication subassembly may include, for example, a transmitter that generates a signal, such as an acoustic or electromagnetic signal, which is representative of the measured parameters. It will be appreciated by one of skill in the art that a variety of telemetry systems may be employed, such as wired drill pipe, electromagnetic, or other known telemetry systems.

Generally, the wellbore 16 is drilled according to a drilling plan that is established prior to drilling. The drilling plan sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also be adjusted as new information is collected.

The data gathered by sensors 24 may be collected by the surface unit 22 and/or other data collection sources for analysis or other processing. The data collected by the sensors 24 may be used alone or in combination with other data. The data may be collected in one or more databases and/or transmitted to another location on-site or off-site. The data may be historical data, real time data, or combinations thereof. The real time data may be used in real time or stored for later use. The data may also be combined with historical data and/or other inputs for further analysis. The data may be stored in separate databases and/or combined into a single database.

Figure 2:
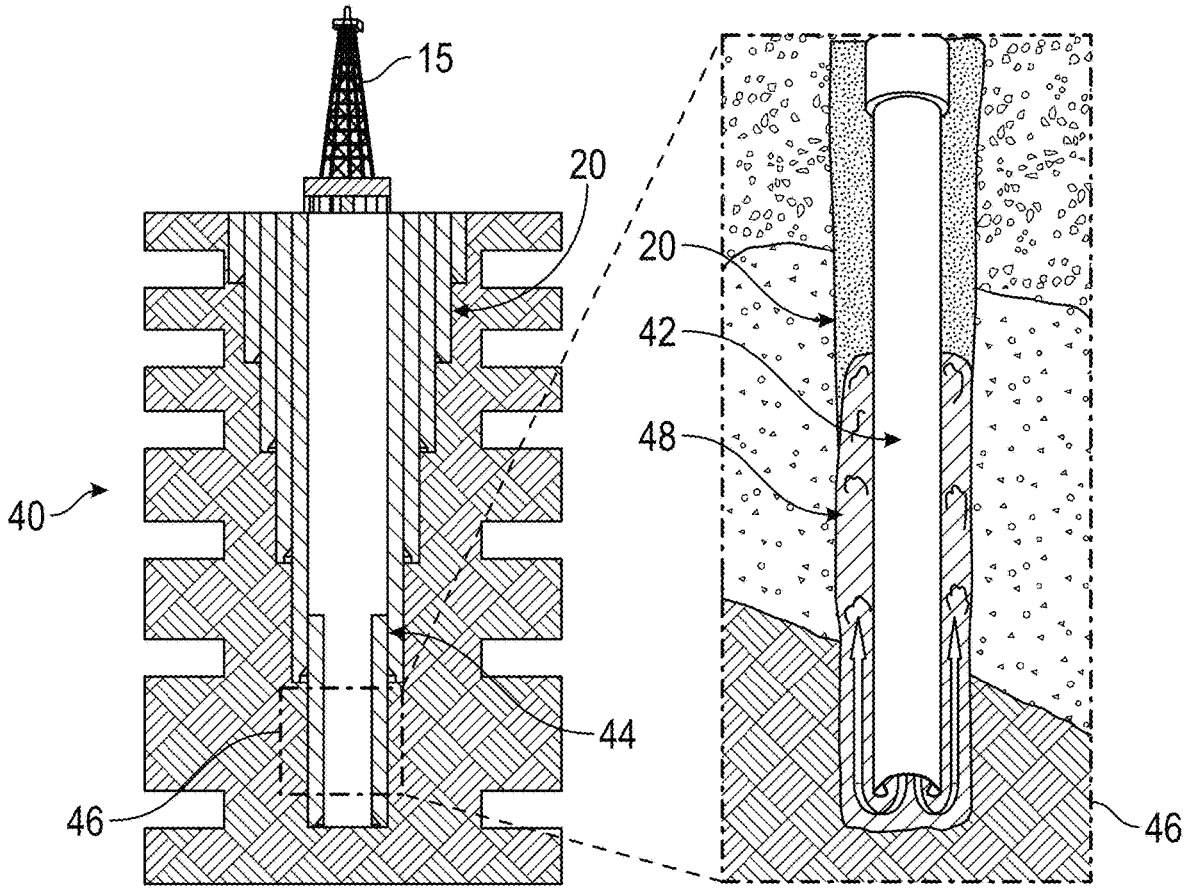
FIG. 2 illustrates a diagram of the wellbore of FIG. 1 in construction of a well, in accordance with embodiments of the present disclosure.

FIG. 2 is a diagram of the wellbore 16 in construction of a well 40. During a well 40 used for oil and gas, a steel casing 42 is inserted into the wellbore 16 and cement sheaths 44 are located around the steel casing 42. As illustrated in a bottom hole 46 in in the wellbore 16, cement slurry 48 is pumped to fill the space between the steel casing 42 and the formation 20. The cement provides mechanical integrity to the wellbore 16 and prevents the uncontrolled release of fluids from the formations 20 into the well. Safety and regulatory requirements necessitate operators to verify the success of the cementing operation using a variety of methods, one of which is known as Top of Cement (TOC).

The TOC is the shallowest depth behind the steel casing 42 for which a cement presence can be verified. The TOC may be a qualitative assessment although it can provide in-depth information. Thus, the TOC need not indicate an assessment of the cement quality behind the steel casing 42. However, relative assessments of the cement placement (e.g., no cement, poor cement, and/or cement present) may be inferred from the TOC measurement in some embodiments.

Figure 3:
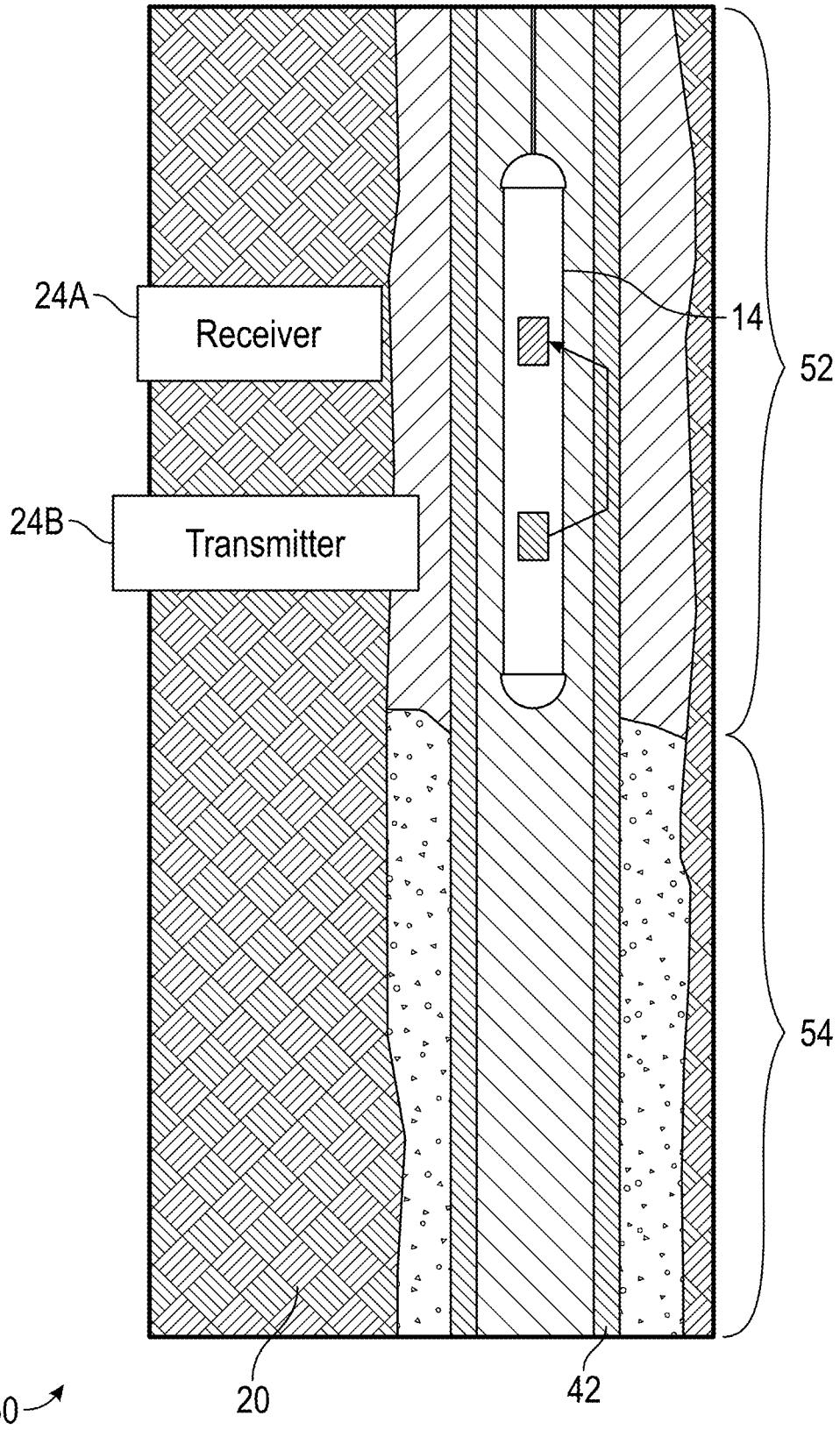
FIG. 3 illustrates a diagram of a top of cement (TOC) measurement in the wellbore of FIG. 1 using a downhole tool, in accordance with embodiments of the present disclosure.
Figure 4:
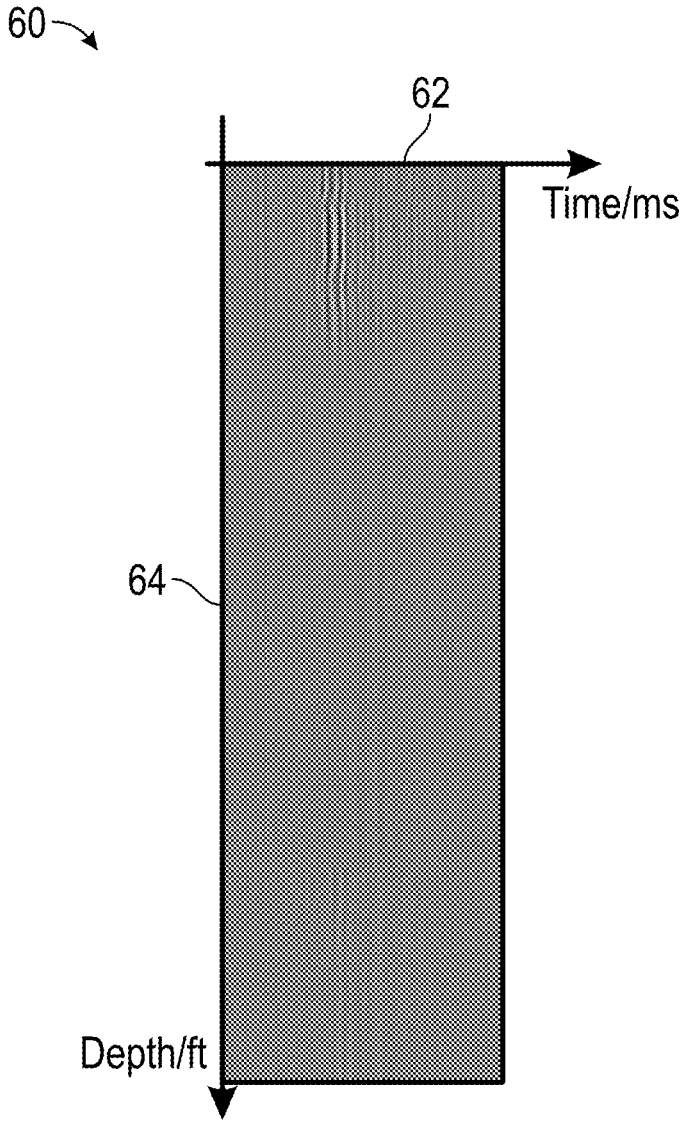
FIG. 4 illustrates a graph of a waveform amplitude captured using the downhole tool of FIG. 3, in accordance with embodiments of the present disclosure.

FIG. 3 shows a diagram 50 of a TOC using one or more downhole sensors 24 (individually referred to as receiver 24A and transmitter 24B). In some embodiments, the receiver 24A and the transmitter 24B may be implemented in the same downhole sensor 24. Additionally or alternatively, the receiver 24A and/or the transmitter 24B may be separate downhole sensors 24. The receiver 24A and the transmitter 24B may be any suitable transmitter and receiver types. For example, the receiver 24A and the transmitter 24B may be sonic tools. Inside of the steel casing 42 in an uncemented portion 52, the amplitude of detected casing arrivals is relatively large, and no signatures from the formation 20 behind the casing are detected. When the steel casing 42 is in a cemented portion 54, low amplitude signals from the transmitter 24B inside of the steel casing 42 are more easily transferred from the steel casing 42 into the formation 20, through the cement. During the TOC logging job, sonic waveform data is collected at different depths. At each depth, the acquired waveforms contain information on the arrivals propagating inside the steel casing 42, including the desired a casing arrival. Once the logging run is complete, all the acquired waveforms can be assembled into a format, such as that shown in FIG. 4. FIG. 4 shows a graph 60 with waveform amplitude at any given time shown as a gradient from black to white. The waveform data can be represented with a 2-/3-dimensional representation with an x-axis 62 being the time and a y-axis 64 being the depth of the capture and the gradient of the point representing amplitude. In this representation, each row represents the amplitude of the waveforms at a certain depth, and each column represents the amplitude at a certain time.

The identification of the TOC is based on the waveform data, the measured amplitudes, and the results from some analysis mechanism(s) (e.g., Slowness Time Coherence (STC) processing). In the first step, a time range window is chosen on the waveform data (e.g., 400 ms-600 ms) inside of which the casing arrival is expected to fall. The waveform in this time range should vary significantly along the depth dimension depending upon the presence or absence of cement at any depth. In the second step, the abrupt changes on the waveform along the depth dimension are captured and interpreted as the change point of cement quality/presence. The depth of the shallowest change point and/or crossing of some threshold may be regarded as the top of cement. However, manually identifying the top of cement and/or verifying results from an AI model is time and resource consuming and may rely heavily on the expertise of a cement engineer.

As discussed below, a self-explainable AI system is designed to interpret the logging while drilling (LWD) sonic waveforms and to identify the top of cement. In parallel, the system provides a zone of interest on the waveform data, indicating the time range on which the system was focused using a time range window when determining the presence or absence of cement. Thus, interpreters may more readily tell whether the inference is reliable or not by reviewing the zone of interest rather than from all of the well log data.

Figure 5:
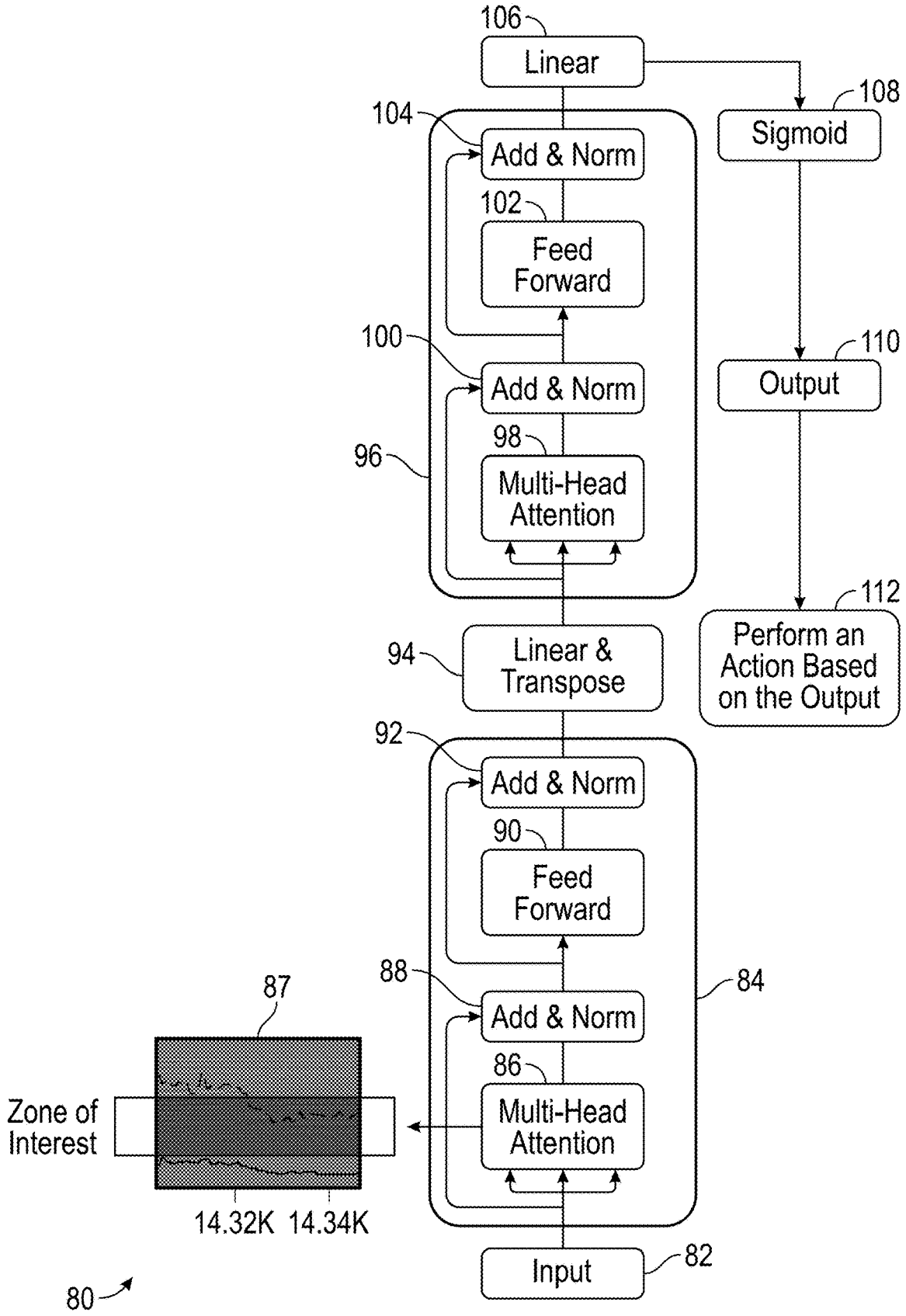
FIG. 5 illustrates a flow diagram of a process for operating a self-explainable AI system using the waveform amplitude of FIG. 4, in accordance with embodiments of the present disclosure.

FIG. 5 is a flow diagram of a process 80 for operating a self-explainable AI system. The process 80 includes receiving an input 82 of input data. For instance, the input data may be the raw and/or filtered data represented in the graph 60 in FIG. 4. This input data may be input as encoded data, visual data, and/or any other suitable data format. For instance, the input data may be displayed in a visualization panel of an application running on a computing system, such as that discussed in relation to FIG. 6, below. Furthermore, as part of the input 82, data channels derived from the input/waveform data may be added to the waveform data. For instance, filtered or unfiltered amplitude data, such as that seen at the top of FIG. 7, may be appended to the waveform data.

The computing system may receive an indication to determine a TOC. For example, a display button and/or a command line instruction may be received via input structures of the computing system. The indication triggers an AI system made up of one or more neural networks to receive the raw data (and derivative data channels) in the one or more neural networks.

The one or more neural networks provide self-explainability by tracking zones of interest 87 used to determine the predicted outputs. This feature may be achieved using attention layers. For instance, a first portion 84 of the one or more neural networks may include a multi-head attention layer 86 to generate a zone of interest 87 output. An attention mechanism in machine learning is an overall level of alertness by reading data, storing feature vectors from the reading, and exploiting the content of the memory to sequentially perform a task by, at each step, focusing attention on one memory element (or multiple weighted memory elements). The attention mechanism may use three components: queries, keys, and values. The multi-head attention layer 86 receives the input 82 as queries, keys, or values. Each query (e.g., vector) is matched against a database (e.g., one or more matrices) of keys (e.g., vectors) to compute a score value. This matching operation may derive a score computed by using an attention function (e.g., dot-product, multiplicative, additive, and/or any other suitable function type). In some embodiments, the score value may be overridden as directed in the input 82. In the multi-head attention layer 86, the scores are passed through a probability function (e.g., softmax) to generate weights. In the multi-head attention layer 86, the weights are applied to the corresponding values and summed to provide a generalized attention as the zone of interest 87. The zone of interest 87 may be graphical, number data, or a combination thereof. For instance, in a graphical representation, an indication may be overlayed on the input 82 data and/or the graph 60 of FIG. 4.

The generalized attention output from the multi-head attention layer 86 is then combined with the input 82 in addition and normalization processing 88. This normalized data is then transmitted to a feed forward neural network 90. Although a feed forward neural network 90 is shown, any suitable neural networks may be used, such as a convolutional neural network or other deep learning neural networks. The output of the feed forward neural network 90 is then normalized and added to an input to the addition and normalization processing 92.

This normalized data is passed to linear and transposition processing 94 to apply a linear function (e.g., scaling) and transpose the normalized data. The data is transposed to perform analysis in a different dimension in a second portion 96 than in the first portion 84 although the first and second portions may be the same portions with different passes of data. For instance, the first portion 84 or first pass may be used to analyze in sliding windows along the time domain while the second portion 96 or second pass may be used to analyze in sliding windows along the depth domain. In other words, in such an example, the first portion 84 or first pass may analyze discrete slices/segments of time (e.g., 1, 2, 3, 4, 5, 10, 15 or more seconds/minutes/hours or any other suitable breakdown of time) while the second portion 96 or second pass may analyze discrete slices/segments of depth (e.g., 50, 75, or 100 or more feet/meters or any other suitable breakdown of depth).

The transposed data is passed into a multi-head attention layer 98 of the second portion 96 that operates on the transposed data like the multi-head attention layer 86 of the first portion 84. Similarly, the addition and normalization processing 100 functions similar to the addition and normalization processing 88, the feed forward neural network 102 functions similar to the feed forward neural network 90, and addition and normalization processing 104 functions similar to the addition and normalization processing 92.

The normalized data is then adjusted with a linear function 106 (e.g., scaling) and then uses a sigmoid function 108 to produce an output 110. Although a sigmoid function 108 is shown, other/additional activation functions may be used. For instance, the sigmoid function 108 may be replaced and/or supplemented by step functions, linear functions, hyperbolic tangent functions, and/or any other suitable transfer functions. The output 110 may be achieved by training the one or more neural networks using historical data (e.g., 30 logs) and correct interpretations of the logs. The output is an indication of whether there is cement present. For instance, a first value (e.g., 0) indicates that no cement is detected (e.g., above TOC) and a second value (e.g., 1) indicates that cement is present. Thus, when the output goes from the first value to the second value, the corresponding depth and time may be indicated as where the TOC was found.

Figure 6:
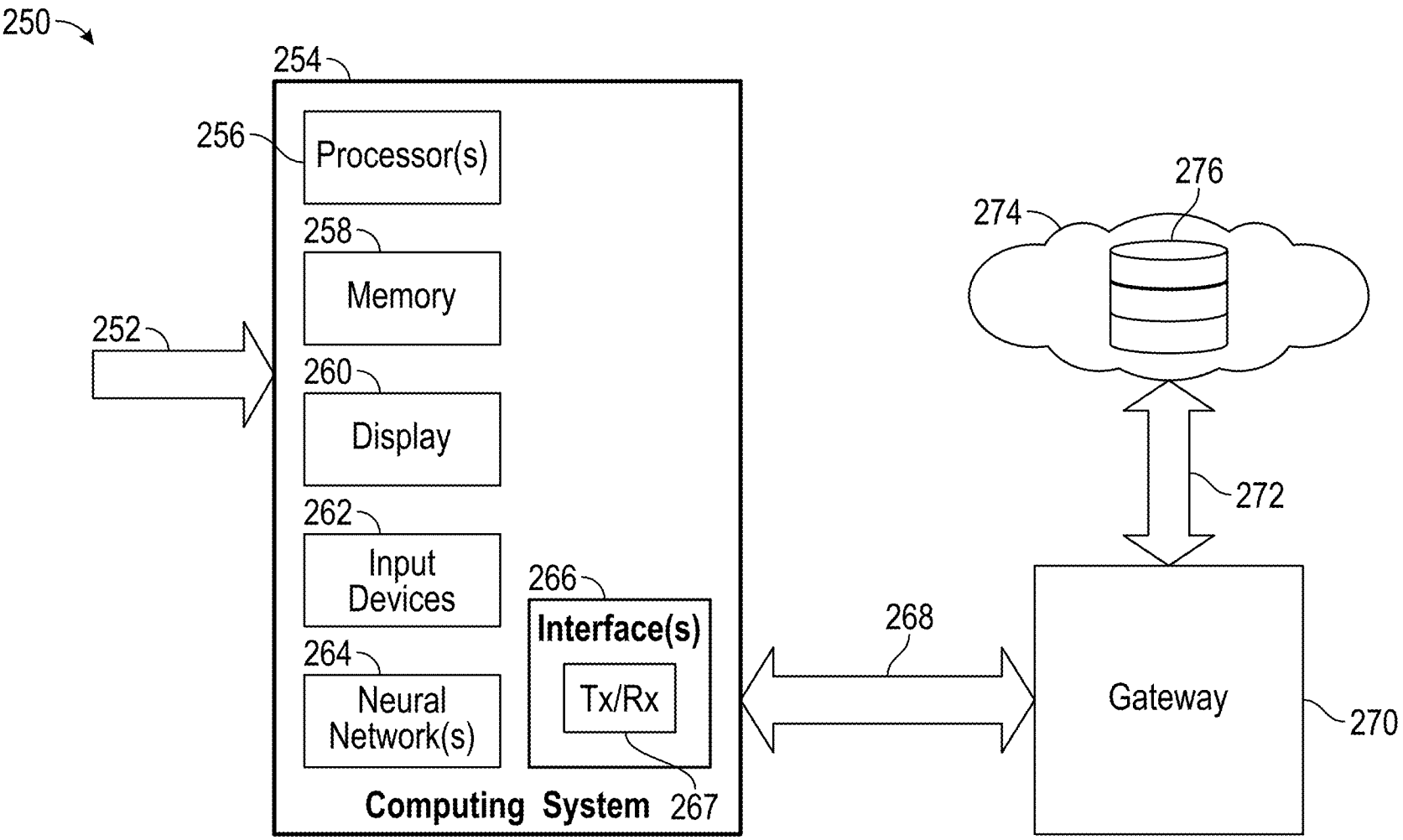
FIG. 6 illustrates a system used to process data from the data capturing system of FIG. 1 and to implement the process of FIG. 5, in accordance with embodiments of the present disclosure.
Figure 7:
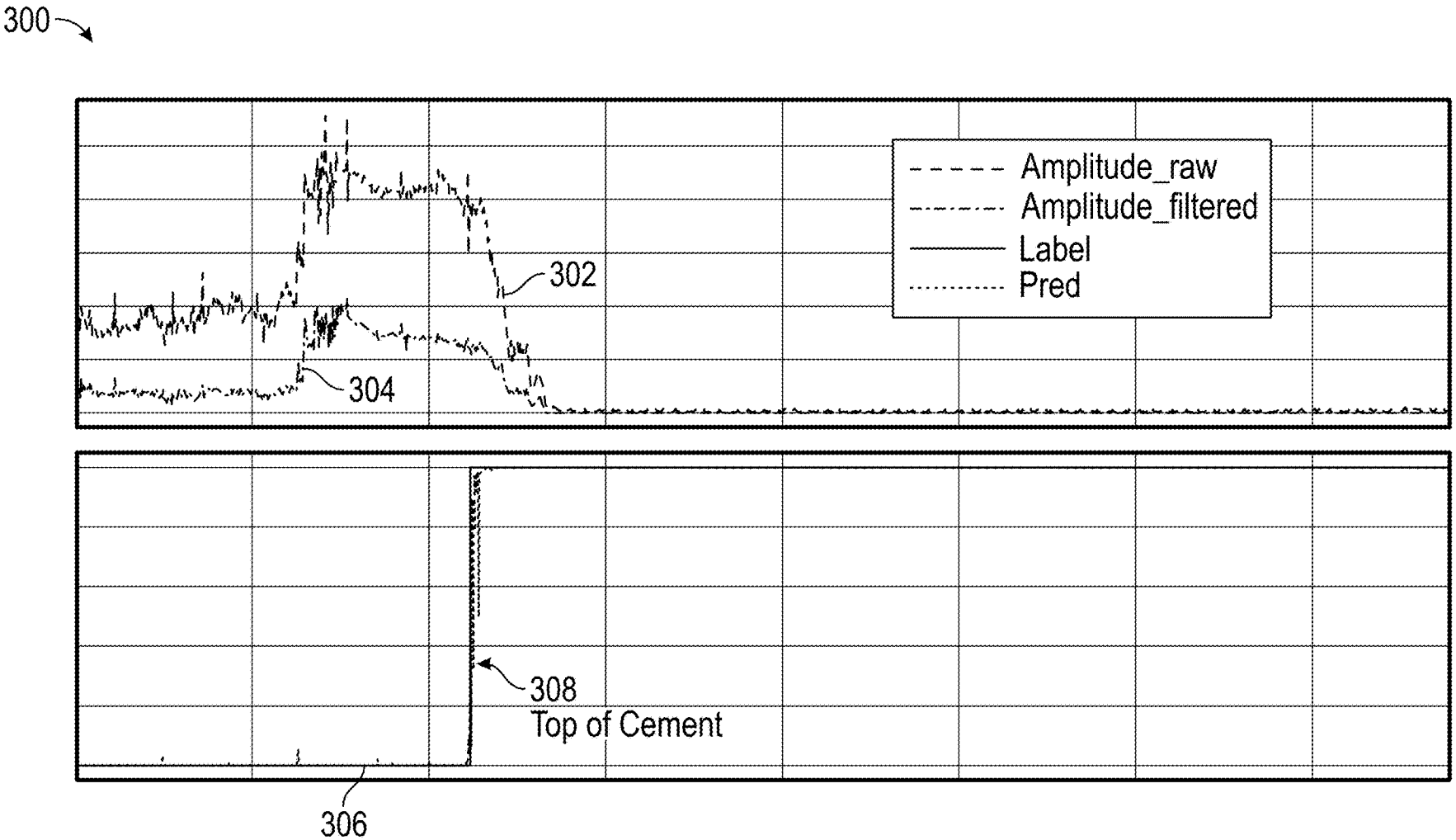
FIG. 7 illustrates a graph showing an inference of the TOC via the TOC process of FIG. 5 using the system of FIG. 6, in accordance with embodiments of the present disclosure.

The output 110 may then be used by a computing system, such as a processor of the computing system discussed in relation to FIG. 6 below used to implement the one or more neural networks, to perform an action based on the inference in the output 110 (block 112). In other words, since the inference of the machine learning is more easily relied upon due to faster/easier verifiability, a processor may be used to automate an action using the output 110. For instance, the processor may allow, permit, and/or cause a stop of cement pumping due to the inferred TOC location. Additionally or alternatively, the processor may allow, permit, and/or cause a next step to be performed, such as starting and/or scheduling a next step in well construction/deployment. Additionally or alternatively, the processor may raise an alert if the TOC depth is below (or above) a threshold range. Additionally or alternatively, the processor may ask for verification using a display coupled to the processor when the TOC depth is outside a threshold of an expected depth. For instance, the expected depth may be based on an estimated volume of the wellbore 16 and the volume of cement pumped into the wellbore 16.

Although the process 80 shows multiple multi-head attention layers, in some embodiments, a single multi-head attention layer may be reused. Additionally, in certain embodiments, multiple multi-head attention layers may be used in the first portion 84 and/or the second portion 96 separately.

The neural network layers (e.g., the multi-head attention layers 86 and 98) give weight to the waveform acquired at each depth/time. Therefore, when new data are fed to the neural model, the model gives the TOC as the output 110 along with the attention layers outputting the weight applied to the waveform at each depth/time in determining the final TOC zone of interest 87. In some embodiments, the TOC may be added to the waveform in the graph 60 and top of cement visualization component, and the weights may be sent to a visualization of the zone of interest 87.

Although specific steps/components are discussed in relation to the process 80, the process 80 may utilize different components and/or steps to provide the output 110 as an inference and/or to provide the zone of interest 87, such as different types or ordering of neural network layers and processing functions. For example, the inference may be made before the zone of interest 87 is generated.

Moreover, the various components/steps/functions discussed in the process 80 may be implemented using hardware, software, or a combination thereof. For instance, FIG. 6 is a block diagram of a system 250 that may be used for analyzing/utilizing the data output 12 from the data capturing system 10, as described in FIG. 1, using the process 80, as described in FIG. 5. The data output 12, as described in FIG. 1, is received as input data 252 at a computing system 254. The system 254 may be implemented in the surface unit 22 and/or may be implemented at other locations within the oilfield or remotely from the oilfield where the remote locations are able to receive the data via the transceiver 32. The various functional blocks shown in FIG. 6 may include hardware elements (including circuitry), software elements (including computer code stored on a tangible computer-readable medium), or a combination of both hardware and software elements. It should be noted that FIG. 6 is merely one example of a particular implementation and is intended to illustrate the types of components that may be present in the computing system 254.

As illustrated, the computing system 254 includes one or more processor(s) 256, a memory 258, a display 260, input devices 262, one or more neural networks(s) 264, and one or more interface(s) 266. In the computing system 254, the processor(s) 256 may be operably coupled with the memory 258 to facilitate the use of the processors(s) 256 to implement various stored programs. Such programs or instructions executed by the processor(s) 256 may be stored in any suitable article of manufacture that includes one or more tangible, computer-readable media at least collectively storing the instructions or routines, such as the memory 258. The memory 258 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 256 to enable the computing system 254 to provide various functionalities. For instance, the one or more processors 256 may include a microprocessor, a central processing unit, a graphics processing unit, an application specific integrated circuit (ASIC), a programmable logic device (e.g., a field-programmable gate array (FPGA) device or a programmable ASIC device).

The input devices 262 of the computing system 254 may enable a user to interact with the computing system 254 (e.g., pressing a button to initiate a TOC determination). The display 260 may be used to show the output 110, the graph 60, an indication of the zone of interest 87, and/or other details related to the process 80. The interface(s) 266 may enable the computing system 254 to interface with various other electronic devices. The interface(s) 266 may include, for example, one or more network interfaces for a personal area network (PAN), such as a Bluetooth network, for a local area network (LAN) or wireless local area network (WLAN), such as an IEEE 802.11x Wi-Fi network or an IEEE 802.15.4 wireless network, and/or for a wide area network (WAN), such as a cellular network. The interface(s) 266 may additionally or alternatively include one or more interfaces for, for example, broadband fixed wireless access networks (WiMAX), mobile broadband Wireless networks (mobile WiMAX), and so forth.

In certain embodiments, to enable the computing system 254 to communicate over the aforementioned wireless networks (e.g., Wi-Fi, WiMAX, mobile WiMAX, 4G, LTE, and so forth), the computing system 254 may include a transceiver (Tx/Rx) 267. The transceiver 267 may include any circuitry that may be useful in both wirelessly receiving and wirelessly transmitting signals (e.g., data signals). The transceiver 267 may include a transmitter and a receiver combined into a single unit.

The input devices 262, in combination with the display 260, may allow a user to control the computing system 254. For example, the input devices 262 may be used to control/initiate operation of the neural network(s) 264. Some input devices 262 may include a keyboard and/or mouse, a microphone that may obtain a user's voice for various voice-related features, and/or a speaker that may enable audio playback. The input devices 262 may also include a headphone input that may provide a connection to external speakers and/or headphones.

The neural network(s) 264 may include hardware and/or software logic that may be arranged in one or more neural network layers. In some embodiments, the neural network(s) 264 may be used to implement machine learning and may include one or more suitable neural network types. For instance, the neural network(s) 264 may include a perceptron, a feed-forward neural network, a multi-layer perceptron, a convolutional neural network, a long short-term memory (LSTM) network, a sequence-to-sequence model, and/or a modular neural network. In some embodiments, the neural network(s) 264 may include at least one deep learning neural network.

The neural network(s) 264 may be used in the process 80 discussed above. The output 110 of the neural network(s) 264 may be based on the input data 252, such as one or more wellbore logs, used to generate the graph 60 and/or the input 82. This output 110 may be used by the computing system 254. Additionally or alternatively, the output 110 from the neural network(s) 264 may be transmitted using a communication path 268 from the computing system 254 to a gateway 270. The communication path 268 may use any of the communication techniques previously discussed as available via the interface(s) 266. For instance, the interface (s) 266 may connect to the gateway 270 using wired (e.g., Ethernet) or wireless (e.g., IEEE 802.11) connections. The gateway 270 couples the computing system 254 to a wide-area network (WAN) connection 272, such as the Internet. The WAN connection 272 may couple the computing system 254 to a cloud network 274. The cloud network 274 may include one or more systems 254 grouped into one or more locations (e.g., data centers). The cloud network 274 includes one or more databases 276 that may be used to store the output of the neural network(s) 264. In some embodiments, the cloud network 274 may perform additional transformations on the data using its own processor(s) 256 and/or neural network(s) 264.

As previously noted, the output 110 may include an inference regarding the TOC. For instance, FIG. 7 includes a graph 300 that may make up and/or be a visual indication of at least a portion of the output 110. As illustrated, the graph 300 includes lines 302 and 304 that respectively correspond to raw and filtered amplitude data plotting the amplitude along the y-axis over depth or time. The graph 300 also includes a line 306 that corresponds to an indication of whether cement is present or not in the output 110. As previously discussed, a change from a first value (e.g., 0) to a second value (e.g., 1) for the line 306 is an indication 308 of an inferred TOC at a specific depth/time from the process 80.

Figure 8:
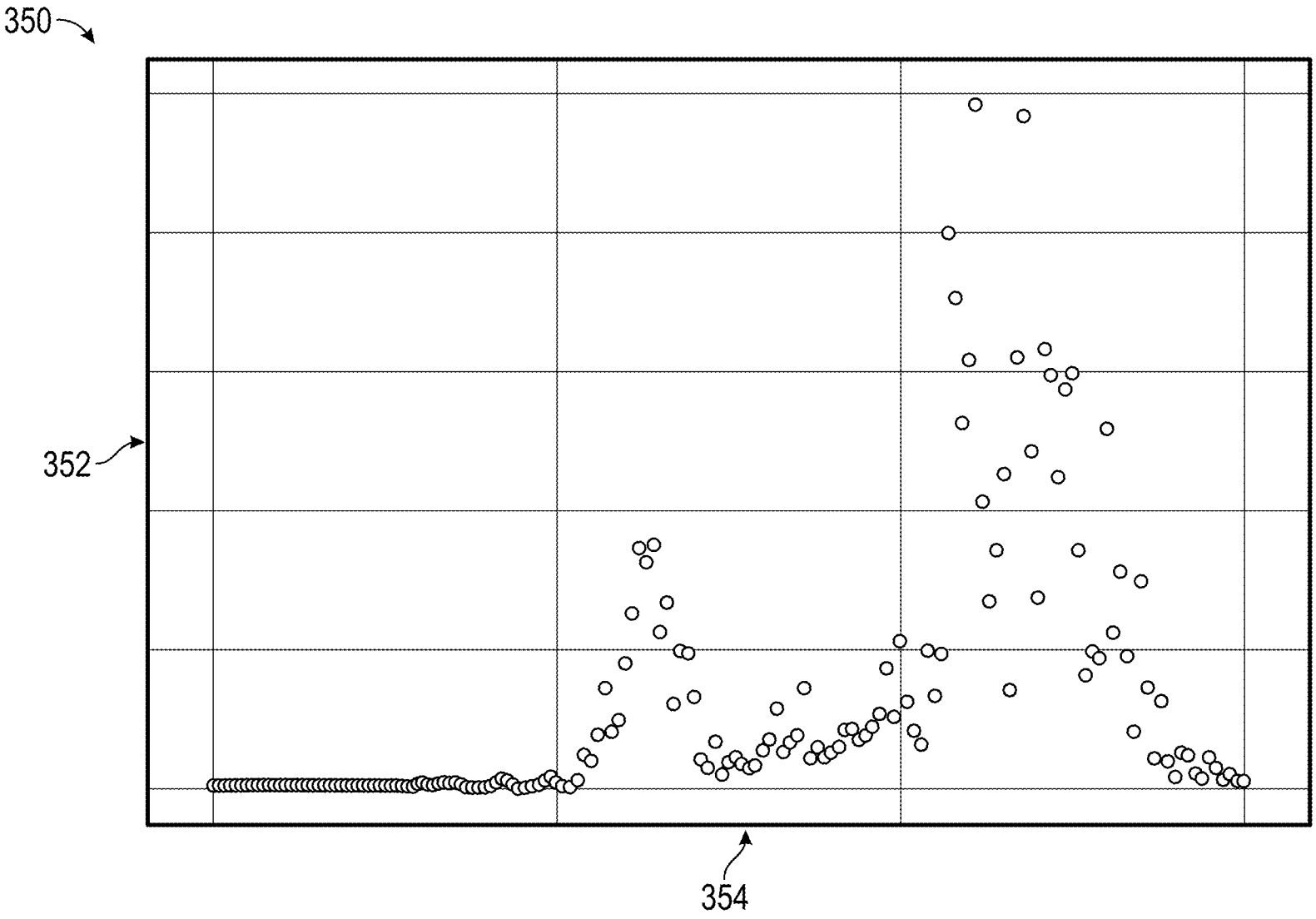
FIG. 8 illustrates a graph showing a zone of interest for the TOC process of FIG. 5 using the system of FIG. 6 when inferring the TOC of FIG. 7, in accordance with embodiments of the present disclosure.

Also, as previously noted, the process 80 may be used to provide the zone of interest 87. FIG. 8 illustrates a graph 350 that is one embodiment of an indication of the zone of interest 87. The graph 350 includes plots of the weights along a vertical axis 352 from the multi-head attention layer(s) 86 and/or 98 against their respective parameters (e.g., depth or time) along a horizontal axis 354.

Although the foregoing discusses TOC determinations, similar techniques may be used for other downhole measurements that may be similarly time consuming in analyzing and due to the complications of downhole measurements in machine learning applications.

The techniques presented and claimed herein are referenced and applied to material objects and cement examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A method, comprising:

obtaining, at one or more neural networks, log data from a wellbore;

generating, using a first multi-head attention layer of the one or more neural networks, a zone of interest based on a first set of probability-based weights applied to the log data;

generating a first output data based at least in part on the first set of probability-based weights, using the first multi-head attention layer of the one or more neural networks;

generating a second output data based at least in part on a second set of probability-based weights, wherein the second set of probability-based weights are generated using a second multi-head attention layer of the one or more neural networks, and the second set of probability-based weights are applied to a transposed of the first output data;

analyzing, in the one or more neural networks, and applying a transfer function to the second output data to infer a downhole characteristic based at least in part on the first output data and the second output data and the first set and the second set of probability-based weights;

outputting, from the one or more neural networks, an indication of an inference of the downhole characteristic and the zone of interest; and performing, using a computer system, an action based at least in part on the indication of the inference of the downhole characteristic and the zone of interest.

2. The method of claim 1, wherein said obtaining the log data comprises receiving the log data and adding one or more channels to the log data using a processor of a system that includes the one or more neural networks.

3. The method of claim 2, wherein the log data comprises sonic data captured using a downhole tool in the wellbore.

4. The method of claim 3, further comprising capturing the log data using the downhole tool, wherein the downhole tool comprises a logging while drilling tool or another wireline tool type.

5. The method of claim 3, wherein the one or more channels comprise data related to raw amplitude data, unfiltered amplitude data, or a combination thereof.

6. The method of claim 1, wherein the downhole characteristic comprises a depth of a top of cement in the wellbore.

7. The method of claim 1, wherein the downhole characteristic comprises a time at which a top of cement occurs in the log data.

8. The method of claim 1, wherein the action comprises the computer system allowing, permitting, or causing a stoppage of pumping of cement based on an inferred top of cement depth in the wellbore.

9. The method of claim 1, wherein the action comprises the computer system allowing, permitting, or causing a next action to be performed based at least in part on an inferred top of cement depth in the wellbore.

10. The method of claim 1, wherein the action comprises the computer system raising an alert if a top of cement depth is below a target location.

11. The method of claim 1, wherein the action comprises the computer system requesting verification if a depth of a top of cement is outside of a threshold range of an expected depth.

12. A method, comprising:

obtaining, using one or more acoustic tools, acoustic log data from a wellbore;

generating, using a first multi-head attention layer of one or more neural networks, a first set of probability-based weights applied to the acoustic log data and a zone of interest based on the first set of probability-based weights;

analyzing, in a first plurality of network layers of the one or more neural networks, the acoustic log data to generate a first output data based at least in part on the first set of probability-based weights;

transposing the first output data in one or more transposition layers of the one or more neural networks;

generating, using a second multi-head attention layer of the one or more neural networks, a second set of probability-based weights applied to the transposed of the first output data;

analyzing, in a second plurality of network layers of the one or more neural networks, the transposed of the first output data to generate a second output data based at least in part on the second set of probability-based weights;

applying a transfer function to the second output data to infer a downhole characteristic based at least in part on the first output data and the second output data and the first set and the second set of probability-based weights;

outputting, from the one or more neural networks, an indication of an inference of the downhole characteristic and an indication of the zone of interest; and performing, using a computer system, an action based at least in part the indication of the inference of the downhole characteristic and the indication of the zone of interest.

13. The method of claim 12, wherein the one or more neural networks comprises a feed forward neural network or a convolutional neural network.

14. The method of claim 12, wherein said generating the first set and the second set of probability-based weights comprises using one or more probability functions.

15. The method of claim 14, wherein the one or more probability functions comprises a softmax function.

16. The method of claim 12, wherein the transfer function comprises a sigmoid function.

17. A system, comprising:

a memory storing instructions; and a processor configured to execute the instructions to cause the processor to:

receive acoustic log data from a wellbore;

generate, using a first multi-head attention layer of one or more neural networks, a zone of interest based on a first set of probability-based weights applied to the acoustic log data;

generate a first output data based at least in part on the first set of probability-based weights, using the first multi-head attention layer of the one or more neural networks;

generate a second output data based at least in part on a second set of probability-based weights, wherein the second set of probability-based weights are generated using a second multi-head attention layer of the one or more neural networks, and are applied to a transposed of the first output data;

analyzing, in the one or more neural networks, and applying a transfer function to the second output data to infer a top of a cement depth in the wellbore based at least in part on the first output data and the second output data and the first set and the second set of probability-based weights;

generate an indication of an inference of the top of the cement depth and an indication of the zone of interest; and perform an action based at least in part on the indication of the inference of the top of cement depth and the indication of the zone of interest.

18. The system of claim 17, wherein the one or more neural networks comprise a feed forward neural network, a convolutional neural network, or a combination thereof.

19. The system of claim 18, wherein the one or more neural networks are implemented using the processor.

20. The system of claim 17, wherein the action comprises:

allowing, permitting, or causing a stoppage of pumping of cement based on the inferred of the top of the cement depth in the wellbore;

permitting or causing a next action to be performed based at least in part on the inferred of the top of the cement depth in the wellbore;

raising an alert if the inferred of the top of the cement depth is below a target location in the wellbore; or requesting verification, via a display of the system, if the inferred of the top of the cement depth is outside of a threshold range of an expected depth.

* * * * *